US005116063A

United States Patent [19]

Harlan et al.

[11] Patent Number: 5,116,063

[45] Date of Patent: May 26, 1992

[54] DART GAME WITH EXPANDED SCORING TECHNIQUE

[75] Inventors: Eugene G. Harlan; Marcio Bonilla; John R. Martin, all of Rockford, Ill.

[73] Assignee: Arachnid, Inc., Rockford, Ill.

[21] Appl. No.: 658,051

[22] Filed: Feb. 20, 1991

[51] Int. Cl.[5] ..... F41J 3/00; F41J 5/04

[52] U.S. Cl. ..... 273/376

[58] Field of Search ..... 273/371-376

[56] References Cited

U.S. PATENT DOCUMENTS

| | | | |
|---|---|---|---|
| 4,057,251 | 11/1977 | Jones et al. | 273/376 |
| 4,516,781 | 5/1985 | DeVale et al. | 273/373 |
| 4,561,660 | 12/1985 | Zammuto | 273/376 |
| 4,586,716 | 5/1986 | Brejcha et al. | 273/376 |
| 4,635,940 | 1/1987 | Kelley | 273/376 |
| 4,793,618 | 12/1988 | Tillery et al. | 273/376 |
| 4,824,121 | 4/1989 | Beall et al. | 273/376 |
| 4,836,556 | 6/1989 | DeVale et al. | 273/376 |
| 4,960,083 | 10/1990 | Inoue | 235/449 |
| 4,976,441 | 12/1990 | Kim | 273/376 |

*Primary Examiner*—Benjamin Layno

*Attorney, Agent, or Firm*—Leydig, Voit & Mayer

[57] ABSTRACT

A target for an electronic dart game including a plurality of slidably mounted scoring segments arranged edge-to-edge and in a circle so as to define different scoring areas. Following a conventional layout for a dart game target, the target has twenty (20) pie-shaped scoring partitions that are placed adjacent to each other so as to form a complete circle. Each partition has a designated score value ranging from one to twenty (1-20) points. Each partition is further divided into the standard three trapezoidal and one pie sub-partitions. In the preferred embodiment, the target further includes a double bull's-eye. A different electrical switch is provided for each scoring segment, and each electrical switch conveys a dart-hit signal in response to its corresponding segment being struck by a thrown dart. Separate and isolated signal lines electronically connected to each switch are provided for communicating the dart-hit signals to processing means of the target. This electronic configuration enables an electronic dart game to support dart games that place a different value on each scoring area, in addition to supporting all contemporary dart games.

8 Claims, 3 Drawing Sheets

DART GAME WITH EXPANDED SCORING TECHNIQUE

FIELD OF THE INVENTION

The present invention relates generally to selfscoring electronic dart games, and more particularly to a target of an electronic dart game having expanded scoring capabilities.

BACKGROUND OF THE INVENTION

Electronic dart games are capable of automatically scoring various dart games. Examples of electronic dart games are disclosed in the following U.S. patents which are herein incorporated by reference: Jones et al. U.S. Pat. No. (4,057,251), DeVale et al. U.S. Pat. No. (4,516,781), Zammuto U.S. Pat. No. (4,561,660), Brejcha et al. U.S. Pat. No. (4,586,716), Tillery et al. U.S. Pat. No. (4,793,618), and Beall et al. U.S. Pat. No. (4,824,121). These patents relate to the use of "safe" darts made with a slender flexible plastic tip which is virtually incapable of piercing human skin and unlikely to cause damage when hitting objects other than the target of the dart game. Jones et al. introduced the safe darts and a dart target divided into an array of target plates or segments with a large number of closely spaced holes for securing darts that strike the target. The impact force of a thrown dart displaces a segment and momentarily closes an associated switch to structurally separate and electronically indicate that a dart has struck the target. DeVale et al. discloses a dart game utilizing at least two microprocessors, wherein a first microprocessor scans a switch matrix to detect if and where a dart strikes the target, and a second microprocessor that performs other computational functions required to operate the dart game. Zammuto improved the electronic dart game by using a solid rubber damper sheet for biasing target segments and a switch matrix of imprinted Mylar sheets to increase reliability of scoring. Brejcha et al. enhanced the layouts of the target by providing a double bull's-eye as in the official bristol dart target of the British Darts Organization. Tillery et al. improved the display capability of the dart game by providing a video display in con]unction with the other user interface components. Finally, Beall et al. improved the video display by enabling an owner or lessee of a dart game to program the dart game so that it displays a customized image when the game is not functioning in play mode.

While all of these references have served to improve on the capabilities of the electronic dart game, the scoring capabilities of the target itself have remained unchanged. Heretofore, a standard target for a dart game has twenty (20) pie-shaped scoring partitions that are placed adjacent to each other so as to form a complete circle. Each partition has a labelled value ranging from one to twenty (1–20) points. Each partition is further divided into three trapezoidal sub-partitions and one pie sub-partition, wherein the pie sub-partition and one of the trapezoidal sub-partitions are worth the labelled value, a second trapezoidal sub-partition is worth double the labelled value, and a third trapezoidal sub-partition is worth triple the labelled value. Contemporary dart games also include a double bull's-eye at the center of the target, wherein the double bull's-eye is configured of an inner and an outer concentric scoring area. The inner circle or double bull's-eye is worth 50 points, and the outer circle or single bull's-eye is worth 25 points.

Since the pie sub-partition and one trapezoidal sub-partition represent an equal score value, conventional practice has been to electronically tie together these two equal-value sub-partitions. Tieing together the equal-value sub-partition simplified the electronic circuitry of the dart game and provided cost effectiveness for a manufacturer. Traditional dart games which have been scored on electrically scored dart machines have not required the sub-partitions of equal value to be wired independently of each other. Therefore, there has not been any recognition of a need or desire to avoid electronically wiring together any of the equal value sub-partitions.

As a result, a new or unconventional dart game that does not treat any of the sub-partitions as equivalents could not be played on a contemporary self-scoring electronic dart game target.

SUMMARY AND OBJECTS OF THE INVENTION

Accordingly, is a primary object of the present invention to provide a target for an electronic dart game, that because of its novel design, enables an electronic dart game to support innovative dart games which could not be previously played on conventional electronic dart games.

In that regard, it is the object of the present invention to provide a target for an electronic dart game that supports innovative as well as not previously playable dart games that assign different score values to each scoring area of the target.

Another object of the present invention is to provide a dart target that enables a conventional electronic dart game to be economically modified so as to accommodate a large variety of innovative dart games.

A further object of the present invention is to include a portion of the scoring electronics within the dart target.

To achieve the foregoing and other objects, the present invention provides a target for an electronic dart including a plurality of slidably mounted segments arranged edge-to-edge in a circle so as to define different scoring areas. Following a conventional layout of a dart game target, the target has twenty (20) pie-shaped scoring partitions that are placed adjacent to each other so as to form a complete circle. Each partition has a designated scoring value ranging from one to twenty (1–20) points. Each partition is further divided into the standard three trapezoidal and one pie sub-partitions. In the preferred embodiment, the target further includes a double bull's-eye. A separate electrical switch is provided for each scoring segment, and each electrical switch conveys a dart-hit signal in response to its corresponding segment being struck by a thrown dart. Separate and isolated signal lines electronically connected to each switch are provided for communicating the dart-hit signals to processing means of the target. This electronic configuration enables an electronic dart game to support dart games that place a different value on each scoring area, in addition to supporting all contemporary dart games.

Other objects and advantages of the present invention will become apparent upon consideration of the following detailed description when taken in conjunction with the drawings.

While the invention will be described in connection with preferred embodiments, there is no intent to limit it to those embodiments. On the contrary, the intent is to cover all alternatives, modifications and equivalents included within the spirit and scope of the invention as defined by the appended claims.

DETAILED DESCRIPTION OF THE PREFERRED EMBODIMENTS

Figure 1:
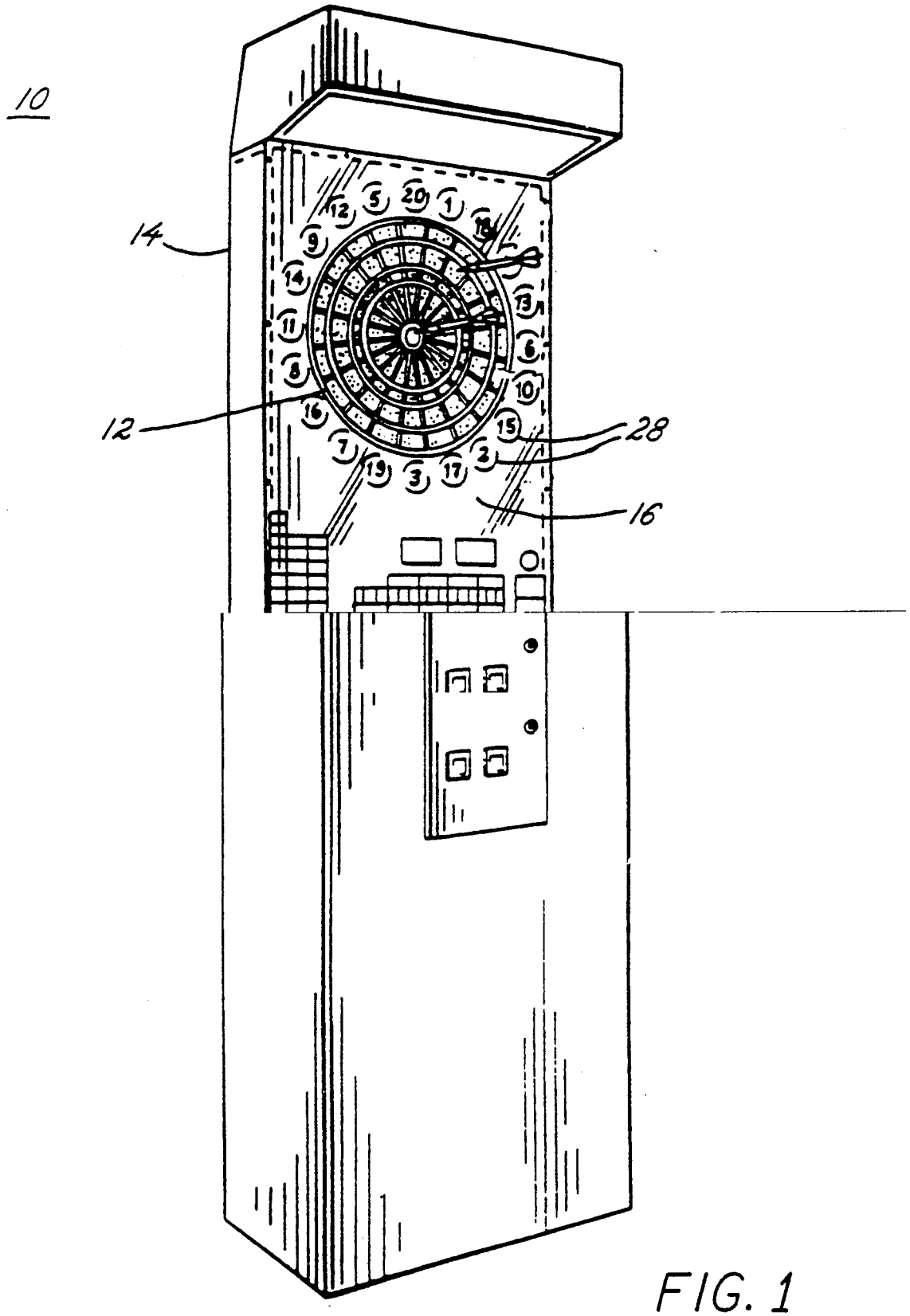
FIG. 1 is a perspective view of an exemplary electronic dart game utilizing a target constructed in accordance with the present invention.

Turning now the drawings, FIG. 1 illustrates an exemplary electronic dart game 10 having a dart target 12 configured in accordance with the present invention. The target 12 is positioned in an upright cabinet 14 that contains electronic components necessary to operate the game 10. The cabinet 14 further includes a cover plate 16 located on the periphery of the target 12. Since electronic dart games are not new per se, further description of the electronic components not directly related to the present invention will be dispensed with as a description of these components may be found in the patents incorporated by reference.

Figure 2:
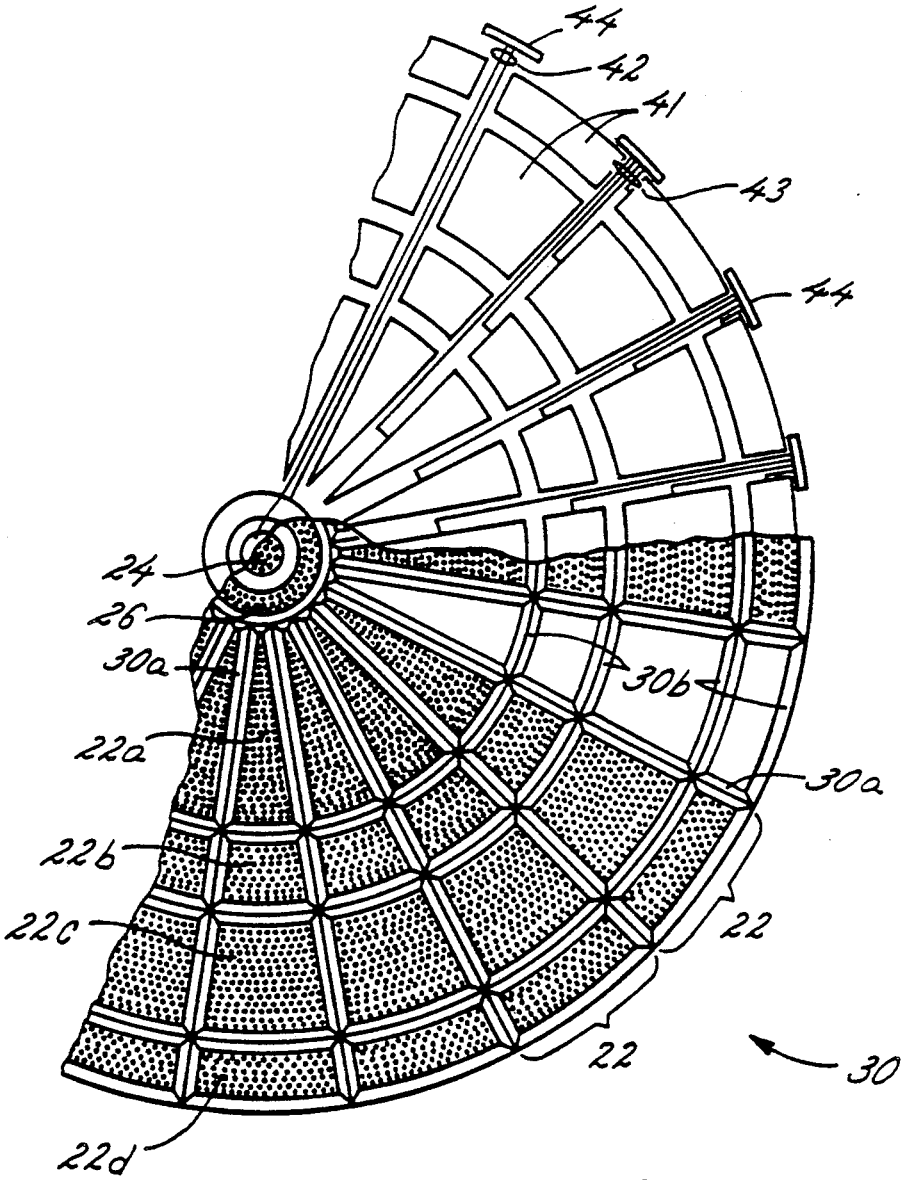
FIG. 2 is an enlarged, elevational view of the target shown in FIG. 1, wherein a portion of the front of the target is broken away in order to show a wiring diagram of the target.
Figure 2:
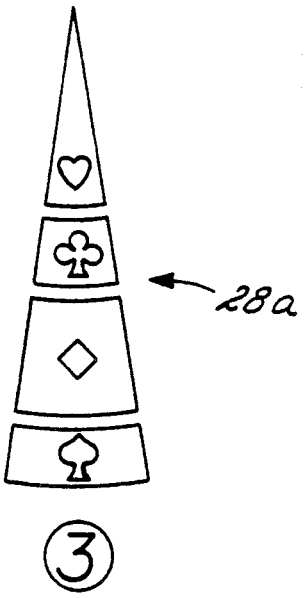

FIG. 2 illustrates an outer face 20 of the target 12 as seen by a dart player, wherein a portion of the outer face 20 is broken away in order to show a wiring diagram of the target 12. The illustrated embodiment reflects a target face 20 configured to receive safety darts. The target face 20 includes twenty pie-shaped partitions 22 that are placed adjacent to each other so as to form a complete circle. Each partition 22 includes four sub-partitions or segments **22*a*–22*d*. At the center of the target face 20 is a double bull's-eye having an inner and an outer circular segment 24 and 26**, respectively. In total, there are eighty-two (82) segments in the illustrated embodiment.

Following a standard layout of an official bristol dart target of the British Darts Organization, the target face 20 has eighty-two (82) scoring areas or segments. Each partition 22 has a designated score value 28 that is clearly indicated on the cover plate 16 at the periphery of the target 12. An example of the indicated score value 28 of each partition is illustrated in FIG. 1.

Each partition includes three trapezoidal and one pie sub-partitions or segments **22*a*–22*d*. Pie segment 22*a* and trapezoidal segment 22*c* are both worth the labelled score value 28. Sub-partition 22*d* is worth double the labelled score value 28, and sub-partition 22*b* is worth triple the labelled score value 28. In conventional dart games, the sub-partitions 22*a* and 22*c*** are treated equally, and therefore, are traditionally tied together electronically.

At the center of the target face 20 is the double bull's-eye having two concentric circles. The inner circular segment or double bull's-eye 24 is worth fifty (50) points, and an outer circular segment or single bull's-eye 26 is worth twenty-five (25) points.

The target face 20 includes a spider frame 30 that functions to define margins of the scoring areas or segments (**22*a*–22*d*, 24, and 26) and to slidably mount the segments within the spider frame 30. The spider frame 30 includes a plurality of radial ribs 30*a*, and a plurality of circular ribs 30*b*. The radial ribs 30*a* divide the target face 20 into the partitions 22, and the circular ribs 30*b* divide the partitions 22 into sub-partitions 22*a*–22*d*. The circular ribs 30*b* also define the double and single bull's-eye 24 and 26, respectively. A more detailed description of the spider frame 30** may be obtained from the U.S. patent to Jones et al.

The target face 20 of the present invention may be configured to accommodate either safety darts or metal tipped darted. In either embodiment, each of the segments are slidably mounted within the spider frame 30. If safety darts are desired, the segments are constructed according to the disclosure in the Jones et al. patent. If metal tipped darts are desired, the segments are constructed of a resilient material such as bristol board.

FIG. 2 further illustrates a pressure sensitive switch matrix 40 that is located behind the target face 20. The switch matrix 40 includes eighty-two (82) electrical switches 41, wherein each electrical switch 41 corresponds to a slidably mounted segment on the target face 20. Each electrical switch 41 is connected to a signal line 42. Groups of signal lines 43 corresponding to the segments of each partition 22 converge at terminals 44. Signal lines 42 corresponding to the bull's-eye segments 24 and 26 are also grouped together and converge at a terminal 44. The terminals 44, in turn, are interlinked to processing means of the dart game 10, or in other a further embodiment, target processing means 58 (to be discussed later).

The practice of electronically tieing together the electrical switches 41 corresponding to segments **22*a* and 22*c* is followed for several reasons. Since segments 22*a* and 22*c*** correspond to equal scoring values in conventional dart games, it has been economically beneficial to electronically tied together equal value segments. For example, FIG. 6 of the Zammuto patent and FIG. 7 of the DeVale patent appear to show electrical switches that are electronically tied together. These electronic configurations operate very effectively for conventional dart games that do not distinguish between different segments sharing equal scoring values. The innovative dart games to be disclosed in the present application, however, require the processing means of a dart game to be able to determine an impact of a thrown dart on each and every particular scoring segment of the target.

In accordance with the present invention, a different electrical switch is provided corresponding to each particular scoring segment, wherein each switch is connected to an electrically independent and isolated signal line that communicates a dart-hit signal from the electrical switch in response to a corresponding segment being struck by a thrown dart. This configuration enables the target to support innovative dart games that place a different score value on each and every scoring segment.

FIG. 2 illustrates how each signal line 42 is electrically isolated from each and every other signal line 42 in the switch matrix 40. As distinguished from conventional dart game target designs, none of the signal lines 42 of the present invention are in contact with each other or electronically tied together. Each signal line 42 remains isolated from the other signal lines 42 along a path from an electrical switch 41, through a terminal 43, to an interface (not shown) with the processing means of the dart game 10.

In the illustrated preferred embodiment, the electrical switches 41 and the isolated signal lines 42 are configured on the switch matrix 40 shown in FIG. 2. In other embodiments, individual switches may be utilized that are hard wired to terminals which interface with the processing means of the dart game 10. The switch matrix 40, however, appears to be the most effective embodiment for economical and performance reasons. As an added feature for improved performance, the switch matrix 40 may include damping means as disclosed in the Zammuto patent. Such damping means prevent false readings of a dart hit caused by a dart that vibrates upon impact with the target 12.

The signal lines 42 are preferably silver ink lines formed on a printed circuit board. A printed circuit board is preferable to hard wires because of improved conductivity and decreased potential for loose connections. The electrical switches 41 are formed of resilient bellows housing electrodes that are constantly urged apart by the bellows. When a dart strikes a segment, the corresponding bellow is compressed which places the electrodes in contact with each other resulting in a "hit signal" to be received by the processing means of the dart game 10.

In accordance with a further embodiment of the present invention, target processing means 58 are provided for identifying which particular segment has been struck by a thrown dart and transmitting this information to the dart game processing means. Dart game processing means in a conventional dart game continuously monitor a conventional dart target in order to determine if a segment has been struck by a thrown dart.

Figure 3:
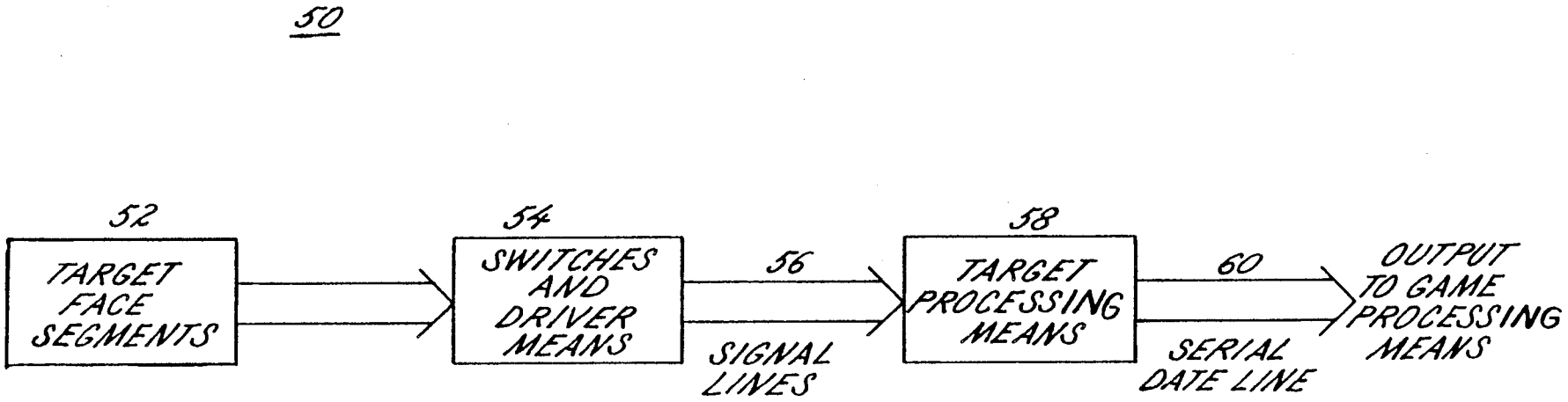
FIG. 3 is a block diagram of a further embodiment of the present invention.

FIG. 3 illustrates a block diagram of a further embodiment of the present invention that includes switches and driver means 54 and target processing means 58. Since the target 12 of the present invention is capable of distinguishing between each and every scoring area that is struck by a thrown dart, this increases the computational activity required by the dart game processing means. The embodiment shown in FIG. 3 is designed to decrease the computational load on the dart game processing means and locate some of the required electronics of the dart game within the target 12.

The target face segments 52 are connected to switches and driving means 54. The driving means provide a toggle voltage, representing the dart-hit signal, for the switches 41 to convey to their corresponding signal lines 56. The driver means may be a power source compatible with the target processing means 58. The target processing means 58 constantly monitor all the signal lines 56 in order to receive a dart-hit signal. Upon receiving a dart-hit signal, the target processing means 58 identify the particular scoring segment that was struck by a thrown dart and then transmit a signal to the dart game processing means identifying the particular struck segment. In this configuration, the dart game processing means receive struck segment transmissions from the target processing means 58, so as to enable the dart game processing means to better handle other computations required to operate the dart game 10. Furthermore, this embodiment reduces the amount of interfacing hardware between the target 12 and other components of the dart game 10. For example, the target processing means 58 communicates with game processing means via a serial data line 60. Each segment corresponds to a unique serial word which the target processing means 58 communicates to the game processing means in response to a dart hit. This embodiment decreases the required signal lines and monitoring demands on the game processing means.

Pursuant to the present invention, there is a limitless variety of innovative dart games that may be implemented on a dart game utilizing a target constructed in accordance with the present invention. One such game may be "Poker Darts." In this game, the target face 20 corresponds to a deck of playing cards. Each partition 22 corresponds to a numerical or face card value of a playing card. For example, partition 22 at the six o'clock position of the target face 20, having a designated score value of 3 on a standard dart target, corresponds to a 3 in each of the four suits. For instance, sub-partition **22*a* corresponds to the 3 of hearts, sub-partition 22*b* corresponds to the 3 of clubs, sub-partition 22*c* corresponds to the 3 of diamonds, and sub-partition 22*d* corresponds to the 3 of spades. Similarly, each of the sub-partitions in the partition 22, having a standard designated value of 13, corresponds to a king of each suit. For added excitement, the double bull's-eye segment 24 may correspond to a joker. Accordingly, dart players are able to play a game of poker. For the matter, the dart players can play any number of card games that are programmed into the processing means of the dart game 10**.

Another dart game made possible by the present invention is "Single Pie Out" which utilizes every scoring segment. In order for a player to win, he or she must hit each and every scoring segment.

A further example of an innovative game made possible by the present invention is called "Bermuda Road", as chosen by the inventors. The object of Bermuda Road is to throw all 3 darts per round at selected scoring areas. If none of the thrown darts hits the selected areas, a player's score is cut in half or the score goes to zero. The game consists of eleven rounds.

Round 1 Player throws all 3 darts at No. 13. Any singles count as 13, any doubles count as 26, and triples count as 39.

Round 2 Player throws all 3 darts at No. 14. Any single counts 14, any double counts 28, and any triple counts 42.

Round 3 Player throws all 3 darts at any double scoring twice the value of the number hit.

Round 4 Player throws all 3 darts at No. 15, scoring 15 points per single hit, 30 points per double hit, and 45 points per triple hit.

5 Player throws all 3 darts at No. 16, scoring 16 points for per single hit, 32 points per double hit, and 48 points per triple hit.

Round 6 Player throws all 3 darts at any triple scoring three times the designated point value. Round 7 Player throws all 3 darts at No. 17 scoring 17 points per single hit, 34 per points double hit, and 51 points per triple hit.

Round 8 Player throws all 3 darts at No. 18, scoring 18 per single hit, 36 per double hit, and 54 per triple hit.

Round 9 Player throws all 3 darts at No. 19. Only darts hitting the pie sub-partition **22*a* of the partition labelled 19** scores a value of 19 points. No other segments count.

Round 10 Player throws all 3 darts at No. 20. Only darts hitting the pie sub-partition **22*a*** of the partition labelled 20 will score a value of 20. No other segments count.

Round 11 Player throws all 3 darts at bull's-eye scoring 50 points per hit.

Remember, any round a player fails to hit the scoring area, that player's total points will be cut in half.

If an owner or lessee of the dart game 10 does not desire to have one cover plate 16 illustrating all the available dart games, because it may be very confusing to the dart players, a plurality of removable cover plates 16 are provided to facilitate conversion of the dart game 10 to the different game modes. Each cover plate 16 corresponds to a variety of game modes. For example, one cover plate 16 includes the markings of a standard dart target, as shown in FIG. 1. Another cover plate 16 is configured for the card game mode and illustrates the card values corresponding to each of the segments. An example of a section of the card game mode cover plate 16 is illustrated by labelled score value 28*a* of FIG. 2.

All the games are programmed into a memory of the dart game 10. The dart game 10 includes selection means for setting the game 10 to the different game modes. The selection means may be a switch located internal or external to the cabinet 14 of the dart game 10. In order for an owner or lessee of the dart game 10 to change the game mode, he or she is only required to change the cover plate 16 (if multiple cover plates are used) and position the selection means to the desired game mode.

As an alternative, a single cover plate 16 corresponding to all the available games can be used, wherein the dart players operate an externally located selection means to choose the desired game to be played.

As an additional feature, a video display as disclosed in the Tillery et al. patent may be attached to the dart game 10. Similarly, the video display may be programmable as disclosed in the Beall et al. patent. Whatever additional features are added to the dart game 10, the expanded scoring technique provided by the present invention enables a dart target to support innovative dart games previously unavailable with conventional dart targets by distinguishing electronically between each and every scoring segment.

We claim as our invention:

1. A dart game for a self-scoring electronic dart game having a target face in front of the target for receiving thrown darts, and a switch matrix behind the target for detecting a thrown dart striking the target, said target comprising:

a target frame having a plurality of radial ribs and a plurality of circular ribs, said target frame defining scoring areas;

a plurality of scoring segments for receiving thrown darts, said segments being slidably mounted in the scoring area;

a pressure sensitive switch matrix situated behind the target face, said switch matrix having a plurality of different electrical switches corresponding to each scoring segment, each electrical switch having electrodes being urged apart by the switch matrix and each electrical switch being capable of conveying a dart-hit signal in response to a thrown dart striking its corresponding scoring segment so as to maneuver the respective electrodes into electrical contact; and said switch matrix further including a plurality of electrically independent signal lines electrically connected to each electrical switch for communicating the dart-hit signal to processing means of a dart game, wherein only one signal line is electrically connected to each electrical switch, and each and every signal line in said switch matrix is structurally separate and electrically isolated from each and every other signal line so that every signal line in the switch matrix only communicates a dart hit signal corresponding to one scoring segment.

2. The target as defined in claim 1, wherein said target supports a dart game requiring every scoring segment to be assigned a scoring value that is unique from every other scoring segment.

3. The target as defined in claim 1, each electrical switch including a resilient bellow containing the electrodes, wherein the bellow constantly urges apart the electrodes until pressure from a dart striking a corresponding segment forces the electrodes in contact with each other resulting in a hit signal being conveyed by said electrical switch.

4. The target as defined in claim 1, said target further comprising:

target processing means for receiving the dart-hit signals from each of the signal lines, wherein the target processing means identify the particular segment that has been struck by a thrown dart and are capable of transmitting a signal to the game processing means identifying which particular segment has been struck.

5. The target as defined in claim 4, further comprising:

means for driving each of said switches so that each switch is capable of providing a toggle voltage to its connected signal line in response to the corresponding segment being struck by a thrown dart, wherein the toggle voltage represents the dart-hit signal to the target processing means.

6. The target as defined in claim 1, further comprising:

a removable cover plate displaying corresponding values of the scoring segments, wherein said cover plate may be removed in order to configure the dart game to support variable game modes.

7. The target as defined in claim 6, wherein said cover plate designates a different value to each and every scoring segment.

8. The target as defined in claim 1 in which the target supports a poker dart game, wherein at least some partitions of the target that traditionally correspond to labelled score values on a conventional dart game target correspond to numerical values of playing cards, and each partition of the target includes one pie sub-partition and three trapezoidal sub-partitions wherein the sub-partitions correspond to different suits of the playing cards, such as hearts, clubs, spades and diamonds.

* * * * *